United States Patent [19]

Kuboyama

[11] Patent Number: 4,678,400

[45] Date of Patent: Jul. 7, 1987

[54] ROTARY MEANS FOR USE AS A HEAT SOURCE

[76] Inventor: Nobuyoshi Kuboyama, 28-9-1, Shimomiyamori, Aza, Miyamori-Mura, Iwate-ken, Japan

[21] Appl. No.: 651,582

[22] Filed: Dec. 3, 1984

Related U.S. Application Data

[63] Continuation of Ser. No. 480,706, Mar. 31, 1983, abandoned.

[30] Foreign Application Priority Data

Apr. 2, 1982 [JP] Japan ..... 57-55089

[51] Int. Cl.[4] ..... F04D 29/38

[52] U.S. Cl. ..... 415/199.4; 126/247; 34/92; 34/15

[58] Field of Search ..... 415/199.4, 199.5, 199.1, 415/213 C, 199.2, 199.3, 199.6, 182, 183, 194, 195; 126/247

[56] References Cited

U.S. PATENT DOCUMENTS

| | | | |
|---|---|---|---|
| 982,393 | 1/1911 | Spencer | 415/199.2 |
| 1,682,102 | 8/1928 | Allen | 126/247 |
| 1,787,654 | 1/1931 | Anderson | 415/183 |
| 2,198,735 | 4/1940 | Morrison | 415/199.2 |
| 3,004,277 | 10/1961 | Allred | 415/199.4 |
| 3,084,850 | 4/1963 | Engalitcheff | 415/193 |
| 3,822,740 | 7/1974 | Hackett | 126/247 |
| 4,224,010 | 9/1980 | Fujino | 415/199.2 |
| 4,319,408 | 3/1982 | Kuboyama | 34/92 |
| 4,424,796 | 1/1984 | Fish | 126/247 |
| 4,426,793 | 1/1984 | Kuboyama | 34/92 |
| 4,457,083 | 7/1984 | Kuboyama | 34/92 |

*Primary Examiner*—Robert E. Garrett
*Assistant Examiner*—John Kwon
*Attorney, Agent, or Firm*—Thomas R. Morrison

[57] ABSTRACT

This invention relates to rotary means equipped with multistage fans having excellent air suction and discharge effect. The multistage fans are spaced from each other disposed perpendicularly in a multistage manner. When such rotary means is disposed in a chamber and the multistage fan are rotated in a clockwise or anti-clockwise direction, air pressure within the chamber gets reduced or pressurized at a balanced level. Thus, the chamber can be used for heating and drying purposes.

7 Claims, 3 Drawing Figures

ROTARY MEANS FOR USE AS A HEAT SOURCE

This is a continuation, of application Ser. No. 480,706 filed Mar. 31, 1983 now abandoned.

BACKGROUND OF THE INVENTION

This invention relates to rotary means equipped with a multistage fan having the excellent effect of air suction and discharge.

The origin of this invention is based on U.S. Pat. No. 4,319,408 entitled "Heating process and its apparatus in reducing air pressure within a chamber at a balanced level" which was invented by the present Applicant. Further, the Applicant has filed corresponding U.S. patent applications Ser. Nos. 329,818 now U.S. Pat. No. 4457083 and 349,064 now U.S. Pat. No. 4426793 and has so far developed various related inventions including the heating process and its apparatus in reducing or pressurizing air pressure within a chamber at a balanced level.

The aforesaid inventions comprise a rotary means for reducing or pressurizing air pressure within a chamber and a suction opening in which the rotary means is disposed, wherein a difference between the reduced or pressurized air pressure within the chamber and the air pressure outside the chamber is maintained at a balanced level, and air friction heat is generated in a gap between the suction opening and the rotary means by rotation thereof, thereby the chamber can be used for drying or heating purposes.

That is to say, means for suctioning and discharging air within the chamber as well as means for generating air friction heat is formed by the rotary means having the suction opening, so that the drying or heating effect is greatly dependent upon whether or not the operational efficiency of the rotary means is high. From this point of view, this invention has been accomplished.

BRIEF SUMMARY OF THE INVENTION

It is an object of this invention to provide novel rotary means equipped with multistage fans having the excellent air suction and discharge effect as well as the excellent heat generation effect, wherein a plurality of fans are disposed co-axially with one other in a multistage manner.

It is another object of this invention to provide novel rotary means equipped with multistage fans, wherein a trailing rotary means is disposed just below the lowest fan of the multistage fans and is driven by rotation of the lowest one whereby, thereby the aforesaid effects are further enhanced.

It is another object of this invention to provide rotary means equipped with multistage fans which can bring a preferred air suction and discharge effect by modifying optionally each fan's size, number of vanes, their inclination and a distance between adjacent fans, etc.

Other and further objects, features and advantages of this invention will appear more fully from the following description.

BRIEF DESCRIPTION OF THE ACCOMPANYING DRAWINGS

PREFERRED EXAMPLES OF THE INVENTION

Preferred examples of this invention will now be described.

Numeral 1 denotes a rotary shaft on which a plurality of fans 2 spaced apart from each other are fixed. Numeral 3 denotes a tubular body in which the plurality of fans 2 are incorporated. The tubular body 3 is provided with a suction opening 4 at the bottom thereof and a discharge opening 5 at the top thereof.

Numeral 6 denotes air friction heat generating means which is formed in a small gap between an interior of the tubular body 3 and an edge of the fan's vane 2*a*. The air can be retained within the gap so that the air friction effect can be increased.

Figure 1:
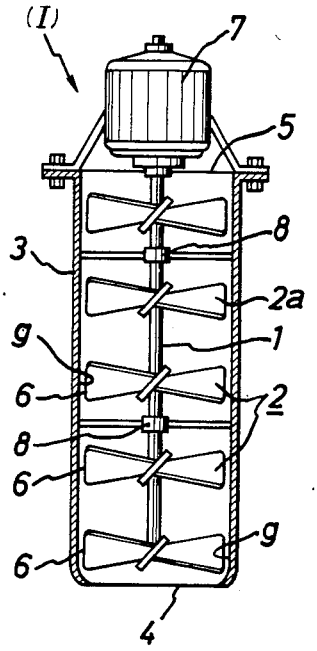
FIG. 1 is a section view of an example of rotary means equipped with multistage fans according to this invention.

In FIG. 1, a plurality of fans 2 are disposed an equal distance from one another, and each fan has the same size, the same number of vanes 2*a* and the same inclination. If necessary, it is optional to modify a distance between adjacent fans, each fan's size, number of vanes 2*a* and their inclination. If the plurality of fans 2 are of a deformed size, it is suitable to change the profile of the tubular body 3 so as to meet the profile of the corresponding fans.

In FIG. 1, the rotary shaft 1 is connected directly to a motor 7. Its speed is variable by way of a transmission gear connected to the motor 7.

Numeral 8 is a bearing mounted on the rotary shaft 1, so that it is smoothly rotatable with the tubular cylinder 3.

Figure 2:
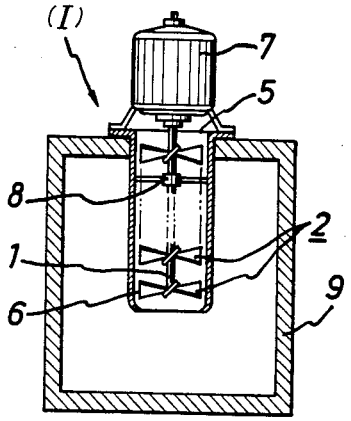
FIG. 2 is a section view of a use condition of the above rotary means.

FIG. 2 is a section view in which rotary means (I) equipped with multistage fans is fixed with a chamber 9.

When the rotary shaft 1 is rotated by the motor 7, and the plurality of fans 2 are rotated in an air discharge direction, the air within the chamber 9 is suctioned forcibly through the suction opening 4, migrated from the lowest fan to the upper fans by rotation of the rotary fans 2 and finally discharged outside the chamber by way of the discharge opening 5. Thus, the air pressure within the chamber 1 is suctioned gradually.

When a difference between a reduced air pressure within the chamber 9 and a normal air pressure thereoutside is maintained at a balanced level, the air is retained in the area of air friction heat generating means 6, thereby the air friction effect is enhanced rapidly and heat is generated by the temperature rise of the retaining air.

When the plurality of fans 2 each having the same profile as shown in FIG. 1 are used, the distribution of the air friction heat is such that the temperature of the air friction heat in the innermost fan faced to the suction opening 4 is the highest, while that in upper fans becomes gradually lower. That is, the air friction heat is most actively generated in the gap g of the innermost fan 2, because the air pressure reduction effect is very large in this area, and no heat loss occurs.

Particularly, as the number of fans 2 is additionally increased more, the test result proves that the effect of the air pressure reduction is accelerated more effectively.

Accordingly, when the chamber 2 is used as a shielded structure for the purpose of generating heat, it becomes a heat source. Further, outer air induction means (not illustrated) may be disposed in the chamber 9 to introduce the outer air thereinto, either automatically or manually. Further, when wet articles are placed in the chamber 9, it may be used as a drying apparatus.

Figure 3:
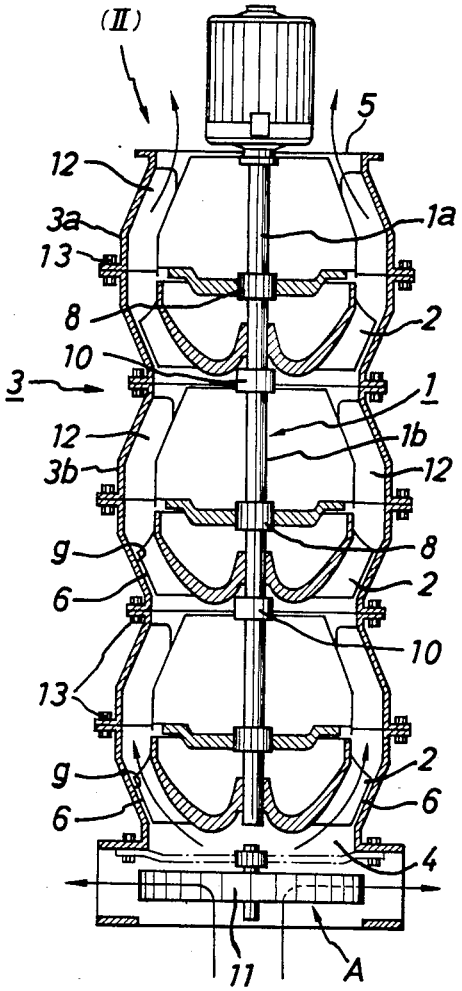
FIG. 3 is a section view of another example of the rotary means equipped with multistage fans according to this invention.

Another example of this invention will now be described with reference to FIG. 3, in which the elements shown in FIG. 1 are indicated by the same reference numerals.

In this example, rotary means (II) equipped with multistage fans is made of a combination of a plurality of tubular bodies 3*a*, 3*b*, . . . individually separable from each other. Namely, each tubular body (made of two members) is a single unit type, wherein each fan is fixed with individual rotary shafts 1*a*, 1*b*, . . . . In this way, the rotary means (II) equipped with multistage fan means is obtained by mounting one single unit type tubular body upon another. The individual rotary shafts are connected with each other by couplings 10. Further, the individual tubular bodies of single unit type are joined with each other by nuts 13.

Likewise in the example of FIG. 1, the second rotary means (II) is provided with the suction opening 4 at the bottom thereof and the discharge opening 5 at the top thereof.

Further, a trailing rotary means A which is driven by rotation of the lowest fan 2 is disposed right below the suction opening 4. The trailing rotary means A is provided with a driven fan 11.

In case the second rotary means II having the trailing rotary means A is mounted in the chamber 9, the trailing rotary means A causes a forcible air circulation within the chamber, and a further temperature rise, whereby the drying effect is enhanced further.

The aforesaid rotary means II which is disposed in the chamber 9 performs the same function as the first rotary means (I), that is, it performs the heating and drying functions in reducing air pressure within the chamber 9 at a balanced level. Further, it is optional to pressurize air within the chamber 9 at a balanced level by rotating the plurality of fans 2 in a reverse direction.

Numeral 12 is a guide blade disposed within each tubular body.

According to one aspect of this invention, since a plurality of fans are disposed in a multistage form in a tubular body, the air reducing effect as well as the air pressurizing effect is increased effectively. Further, by adding a trailing rotary means to the rotary means equipped with multistage fans, the air suction and dischange function is increased much more.

According to another aspect of this invention, the multistage fans can be separated individually in a unit type, thereby enabling easy assembling at a working site as well as easy transportation.

Still further, by modifying selectively each fan's size, number of vanes, their inclination and a distance between adjacent fans, a very unique rotary means equipped with multistage fans may be obtained and applied for various purposes.

What is claimed is:

1. Rotary means for use as a heat source in a sealable chamber wherein air pressure within said sealable chamber is reduced or pressurized at a balanced level by discharging air from the chamber or introducing air thereinto, comprising:

a first fan;

said first fan including a first fan vane affixed for rotation upon a first rotary shaft and a first tubular body enclosing said first fan vane;

at least a second fan;

said second fan including a second fan vane affixed for rotation upon a second rotary shaft and a second tubular body enclosing said second fan vane;

means for coupling said first and second rotary shafts together for concerted rotation thereof and of said first and second fan vanes;

means for joining said first and second tubular bodies to form a combined tubular body;

an air discharge opening from said combined tubular body in one of said first and second tubular bodies;

an air suction opening to said combined tubular body in the other of said first and second tubular bodies;

each of said first and second fans including an air friction heat generating means between its fan vane and its tubular body;

means for permitting air friction heat generated by said air friction heat generating means to be added to said sealable chamber;

trailing rotary means disposed adjacent one of said air suction opening and said air discharge opening, said trailing rotary means being rotatable by rotation of air at said one of said air suction and said air discharge openings whereby air friction heat is distributed.

2. Rotary means according to claim 1 wherein said at least a second fan includes at least one of a fan size, a number of said fan vanes and an inclination of said fan vanes which is different from said first fan whereby generation of said air friction heat is improved.

3. Rotary means according to claim 2 wherein said at least a second fan includes at least a second and a third fan, and said means for joining includes means for providing a first distance between fan vanes of one adjacent pair of said first, second and third fans which is different from a second distance between fan vanes of a second adjacent pair of said first, second and third fans whereby generation of said air friction heat is further improved.

4. Rotary means according to claim 1 wherein each of said first and at least a second fan includes bearings for rotatably supporting said first and second rotary shafts.

5. A rotary means according to claim 1 wherein said means for joining includes bolts.

6. Rotary means according to claim 1, wherein at least one of said air friction heat generating means include an air gap between said fan and said tubular body thereof.

7. Rotary means according to claim 1, wherein said air gap is substantially smaller than to said rotary means.

* * * * *